United States Patent [19]

Weiss

[11] 4,091,493

[45] May 30, 1978

[54] PAINT ROLLER SHIELD

[76] Inventor: Nathan Weiss, 927 Parkbrook St., Spring Valley, Calif. 92077

[21] Appl. No.: 815,082

[22] Filed: July 13, 1977

[51] Int. Cl.[2] ..... B05C 17/02

[52] U.S. Cl. ..... 15/248 A

[58] Field of Search ..... 15/27, 230.11, 248 A; 401/197, 208, 218-220

[56] References Cited

U.S. PATENT DOCUMENTS

| | | | |
|---|---|---|---|
| 2,160,570 | 5/1939 | Welt | 15/27 UX |
| 3,409,929 | 11/1968 | Fisher | 15/248 A |

FOREIGN PATENT DOCUMENTS

| | | | |
|---|---|---|---|
| 547,401 | 5/1956 | Belgium | 15/248 A |

*Primary Examiner*—Daniel Blum
*Attorney, Agent, or Firm*—Jack C. Munro

[57] ABSTRACT

A shield to prevent splattering and dripping of paint for a paint roller, such a paint roller being conventional using a nap type of a roller which is rotatably mounted upon an offset handle. The shield comprises a center part to which is hingedly secured front and back sections. Elastic bands are employed on each end of the housing to hold together the front and back sections to the center part when in operation. Also, the elastic bands function to connect the shield to the paint roller structure. In the shielding position, the housing surrounds the paint roller to intercept the paint spray. When the roller is removed from the painted surface, the shield is free to pivot to catch droplets that would otherwise fall to the floor. An adjustable adaptor assembly is employed on each end of the housing to permit the shield to be employed with rollers of different nap thicknesses. A roller assembly is connected to both the front and the back parts so that the device, when in use, will low frictionally roll on the surface to be painted thereby not permitting the shield itself to come into contact with the painted surface.

6 Claims, 5 Drawing Figures

PAINT ROLLER SHIELD

BACKGROUND OF THE INVENTION

While roller painting is generally faster and less tiring for the painter, several problems are experienced in the use of rollers. The rolling motion produces a splatter or spray in which a multitude of small specks of paint are sprayed over the surrounding area. As a consequence, the painter, as well as the surrounding areas, unless covered, tend to be speckled. This often requires substantial clean-up, a task that is generally undesirable. Furthermore, if an excess amount of paint is applied to the roller which is frequently true, substantial sized droplets can occur that unless otherwise intercepted, descend to the adjacent floor area.

Many prior art devices, have proven to be unsatisfactory in one or more operating characteristics. Some of the prior art devices do not effectively eliminate spray and are totally ineffective in eliminating dripping. Other prior art devices greatly complicate the operation of applying paint to the roller. Also, several of the prior art devices are complicated in construction, incorporating springs, levers, cables or other moving parts. Also, such prior art devices are frequently subject to wear and periodic breakdowns. Also, some of the prior art devices are designed to fit only one type of roller and are not adaptable to fit other types of rollers or compensate for slight manufacturing irregularities. Several prior art devices are not designed to maintain proper alignment with respect to the surface being painted and as a consequence the painted surface may be scored or otherwise damaged. A further deficiency concerning certain prior art devices relates to their inability to adapt to ceiling painting as well as wall painting. Also, various of the prior art devices are prone to being dislodged from the roller causing interruption of the painting operation as well as permitting paint to deposit in undesired areas. Further, many prior art devices are incapable of accommodating effectively to wall irregularities at the same time maintaining efficient operation.

Therefore, there has been a need for a roller spray and drip shield that completely eliminates spraying and dripping, is easy to use, is reliable and permits maximum painting efficiency with the minimum of clean-up problems.

SUMMARY OF THE INVENTION

The structure of this invention is summarily described in the Abstract of The Disclosure and reference is to be had thereto.

One of the objects of this invention is to provide a new and improved roller spray and drip shield characterized by an economy of parts and subject to little wear.

Another object of this invention is to provide a new and improved roller spray and drip shield adaptable to fit the different major types of rollers.

Another object of this invention is to provide a new and improved roller spray and drip shield that accommodates slight variations between similar types of paint rollers.

Another object of this invention is to provide a new and improved roller spray and drip shield that maintains correct alignment with respect to the surface being painted.

Another object of this invention is to provide a new and improved roller spray and drip shield that permits the simple application of paint to the roller.

Another object of this invention is to provide a new and improved roller spray and drip shield that is useful for ceiling painting and captures particles dislodged from the ceiling.

Another object of this invention is to provide a new and improved roller spray and drip shield that is easy to assemble and remove from the roller.

DETAILED DESCRIPTION OF THE SHOWN EMBODIMENT

Figure 1:
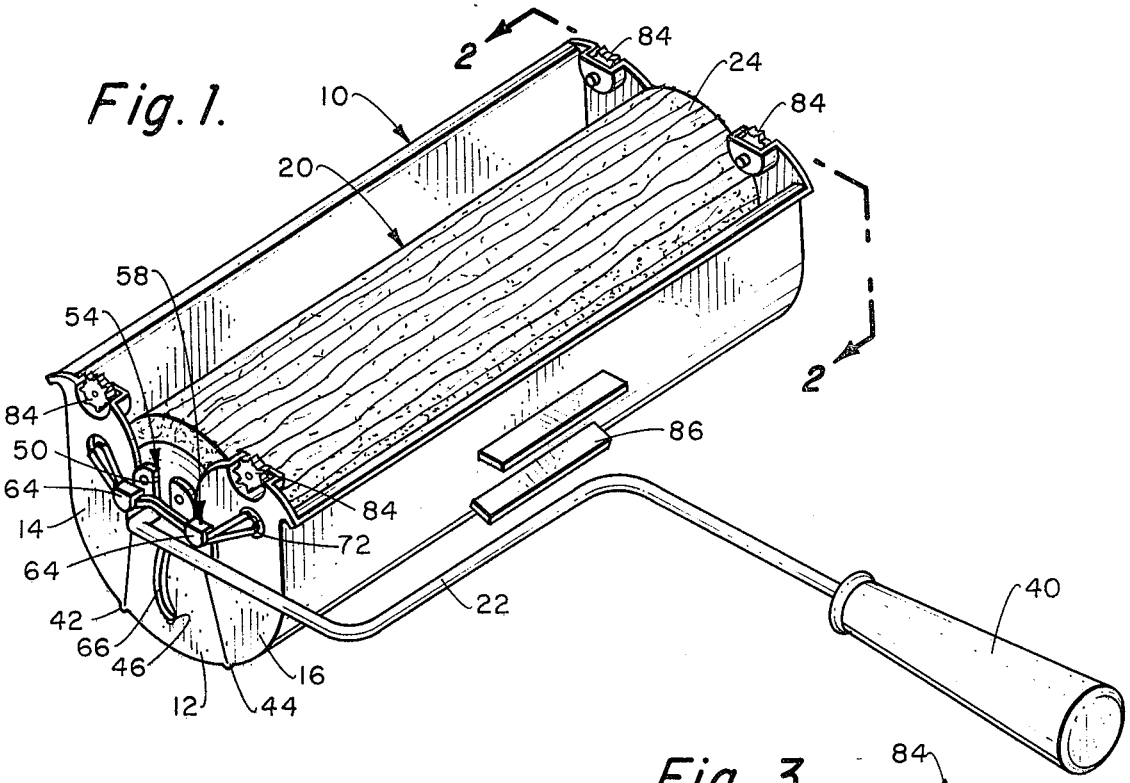
FIG. 1 is a bottom perspective view of the shield of this invention as it is mounted upon a paint roller applicator.
Figure 2:
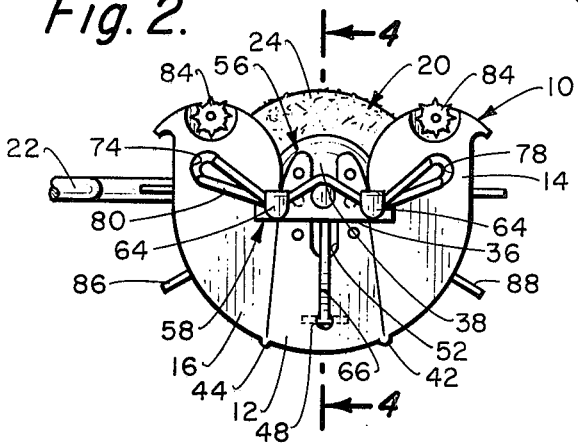
FIG. 2 is an end view taken along line 2—2 of FIG. 1.

Referring particularly to the drawing, there is shown in FIG. 1 the shield or housing 10 of this invention which is composed mainly of a center part 12 and a forward section 14 and a back section 16. The housing 10, when it is in use or the normally at rest position, assumes a basic U-shaped in cross section and forms a substantially elongated U-shaped internal chamber 18. When in use, the conventional paint applying roller 20 is to be substantially wholly located within the chamber 18. The location of the roller 20 within the chamber 18 will be such that just a portion of the periphery of the roller 20 will protrude exteriorly of the chamber 18. It is this portion of the roller that will be doing the painting operation.

The roller 20 includes a cylinder shaped nap 24 which is fixedly secured upon a rigid cylinder 26. The cylinder 26 is hollow forming an interior elongated chamber 28 which is open at both ends. Within the chamber 28 is to be placed cylinder member 30 which is to firmly hold the roller 20 thereon but also to facilitate removal and replacement of the roller. The cylinder 30 includes end caps 32 and 34. An elongated rod member 22 passes through the center of the end cap 34 and is fixedly secured to the center of the cap 32. For purposes of this invention, it is necessary that a second cap 36 to be located about the end cap 32 and in tightly abutting contact with the rigid cylinder 26. The second cap 36 also includes an extension 38 which is centrally mounted upon the cap 36 and extends exteriorly therefrom.

The rod member 22 includes an offset section which is deemed to be conventional and the free end of the member 22 is fixedly secured to a handle 40. Again, this is deemed to be conventional. It is to be understood that the construction of the roller and its handle assembly is deemed to form no direct part of this invention, it only being described for purposes of background information.

Figure 3:
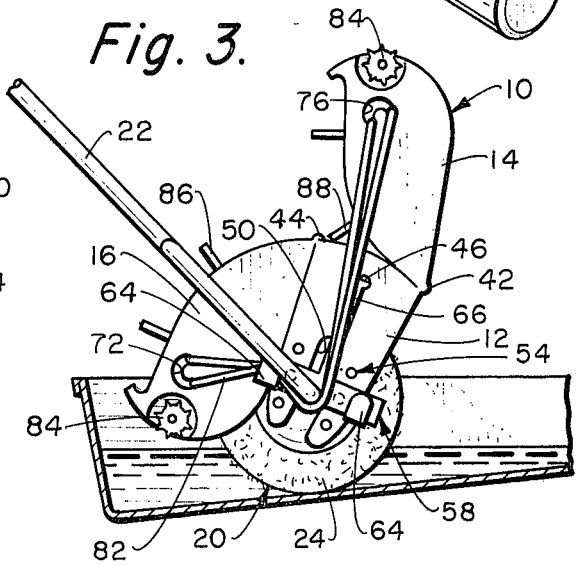
FIG. 3 is an end view of the device of this invention showing such being placed within a roller pan and paint being applied to the roller.
Figure 4:
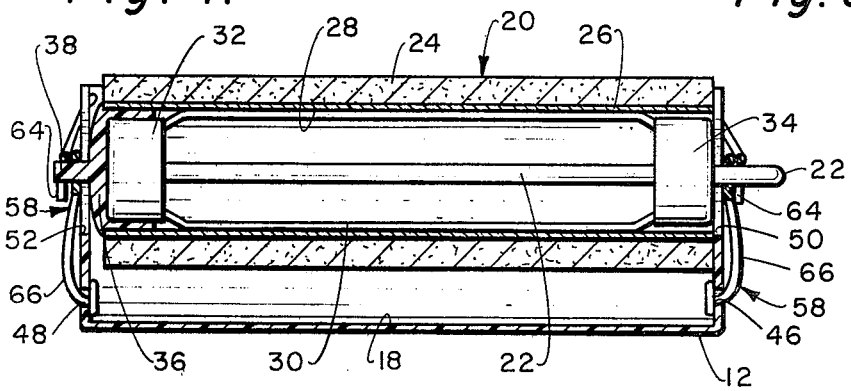
FIG. 4 is a cross-sectional view taken along line 4—4 of FIG. 2.

The sections 14 and 16 are hingedly connected by hinge assemblies 42 and 44, respectively, to the center section 12. Either section could be pivoted if desired to the position shown substantially within FIG. 3 of the drawing. The pivoting of the sections 14 and 16 will be for the purpose of applying paint to the paint roller 20, such as shown in FIG. 3. The hinge assemblies 42 and 44 can be any type of conventional hinge assembly, but it being preferable that an integral "living hinge" (a thin strip of plastic material) be employed. It is to be understood that in all probability, the members 12, 14 and 16 will be constructed of a plastic material.

Within each end of the center section 12 is located an opening 46 and 48, respectively. Also located within each end of the section 12 is a slot 50 being located adjacent opening 46 and slot 52 being located adjacent opening 48. Adjacent the slot 50 is a series of small openings 54 with the openings 54 being divided into three separate pairs of openings. In a similar manner, there is to be a set of openings 56 located adjacent the slot 52 with the openings 56 also being divided into three separate pairs of openings.

Figure 5:
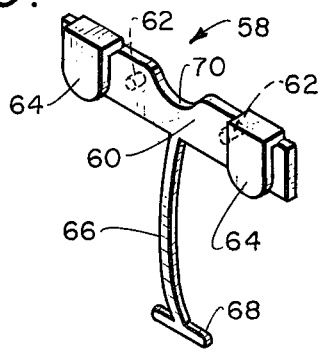
FIG. 5 is an isometric view of the adaptor which is employed in conjunction with the structure of this invention.

An adaptor 58 shown specifically in FIG. 5 of the drawing is to be employed on each end of the member 12. Each adaptor 58 includes a main section 60 which has formed on its inner surface thereof a pair of protuberances 62. A pair of substantially L-shaped members 64 are attached to the upper edge of the main member 60 and extend parallel to the outer surface of the main member 60 but spaced slightly therefrom. Attached to the lower edge of the main member 60 is a flexible member 66 which terminates in a cross member 68. The cross member 68 is to be placed through either opening 46 or opening 48 (depending on which side the adaptor 58 is installed). The protuberances 62 are to be installed within a single pair of the aligned pairs openings within a series of openings either 54 or 56. The upper edge of the main member 60 includes a recess 70 within which either the rod 22 is to be located or the extension 38 (depending upon which end the adaptor 58 is located). Therefore, it is to be readily apparent that by the locating of the protuberances 62 into what pair of openings, the roller 20 is located more deeply within the chamber 18 or is located more shallowly within the chamber 18. By the use of adaptor 58 the shield of this invention is adaptable to rollers of different thicknesses of nap. It is to be understood that the member 22 will extend through the slot 50 with the extension 38 extending through the slot 52 and each will rest within a recess 70 of the adaptor 58.

Located within one end of the member 16 is a U-shaped slot 72. A similar slot 74 is located in the opposite end of the member 16. A similar pair of slots 76 and 78 are located within the member 14. Each of the slots 72 through 78, because of their shape, produces a protruding member within a slot. To be located about the protruding members of slots 74 and 78 is an elastic band 80. A similar band 82 is to connect between the slots 72 and 76. Each of the bands 80 and 82 is to connect with the members 64 of its respective adaptor 58 and extend over either the rod 22 or the extension 38. The elastic bands 80 and 82 are of sufficient strength to actually support the entire shield 10 upon the roller assembly.

Rotatably mounted within chambers formed within the members 14 and 16 are rollers 84. The rollers 84 are to be in contact with the painted surface and keep the shield structure itself slightly spaced from the painted surface. There is to be a roller 84 rotatably mounted within each end of each member 14 and 16. The rollers 84 will normally be constructed of a plastic material having a plurality of small protruding teeth located about the periphery. This type of a roller 84 will cause a very small amount of surface area to be in contact with the painted surface and will not be constructed of material that will absorb any paint.

Formed on the exterior surface of the member 16 is a stop 86. A similar such stop 88 is formed on the back of the member 14. The stops 86 and 88 are to come into contact with the outer surface of the member 12 and limit the pivotal movement of its respective member 14 or 16. Reference is to be had to FIG. 3 of the drawing where it is shown that stop 88 is in contact with the outer surface of the member 12 with the member 14 being pivoted in respect thereto.

Either member 14 or 16 may be moved manually to the paint loading position of FIG. 3. Upon release of either member 14 or 16, the elastic bands 80, 82 cause the return of the members to the position shown in FIG. 1.

What is claimed is:

1. A paint spray and drip shield adapted to be used with a conventional paint roller and handle wherein the roller is rotatably mounted on the handle, said paint spray and drip shield comprises:

a housing including an elongated center member which has a first pair of upstanding end walls at the ends thereof, a front member hingedly connected to one side of said center member, a back member hingedly connected to the opposite side of said center member, said front member terminating in a second pair of upstanding end walls, said back member terminating in a third pair of upstanding end walls, said front and back members being substantially mirror images of each other, with said front and said back members in abutting contact with said center member there is formed an elongated U-shaped chamber within which is to be located a paint roller, with said center member in abutting contact with said front and said back members said end walls cooperating at each end to form a continuous first end wall and a continuous second end wall;

first securing means connected with said continuous first end wall, second securing means connected with said continuous second end wall, said first securing means and said second securing means cooperating to secure said housing to a conventional paint roller assembly, said first and said second securing means normally biasing said front and said back members into abutting contact with said center member; and roller means connected to said housing to contact the surface being painted and low frictionally roll there along keeping said housing slightly spaced from the surface to be painted.

2. The shield as defined in claim 1 wherein:

both said first securing means and said second securing means including the use of an elongated elastic band.

3. The shield as defined in claim 2 wherein:

said hinging together of said members being accomplished with a thin strip of material for each hinge being integral with said members.

4. The shield as defined in claim 1 wherein:

said first and second securing means includes adjustment means connected with said first pair of upstanding end walls of said elongated center member, said adjustment means to permit locating of the paint roller at various depths within said U-shaped chamber, whereby depending upon the thickness of the nap upon the paint roller the position of the paint roller is preselected.

5. The shield as defined in claim 4 wherein:

said adjustment means comprises an adaptor member with there being a separate adaptor member for each said end wall of said elongated center member, said adaptor member to be fixable at various positions upon its respective said end wall, said adaptor member to connect with its respective said securing means.

6. The shield as defined in claim 5 wherein:

each said adaptor member including an elongated flexible member, a free end of said elongated flexible member connecting with its respective said upstanding end wall, whereby upon readjusting of said adaptor to a different position the said elongated flexible member insures that said adaptor remains connected to said center member.

* * * * *